United States Patent [19]

Scouten et al.

[11] 4,072,521

[45] Feb. 7, 1978

[54] AMIDES OF ω — AND CIS ALKENOIC ACIDS IN IMAGING PROCESS AND ELEMENT

[75] Inventors: Charles G. Scouten, Webster, N.Y.; Willard C. Hamilton, Morganville, N.J.

[73] Assignee: Xerox Corporation, Stamford, Conn.

[21] Appl. No.: 692,262

[22] Filed: June 3, 1976

[51] Int. Cl.[2] ..... G03Q 13/22; G03Q 5/02; G03Q 5/04

[52] U.S. Cl. ..... 96/1.5 R; 96/1.8; 96/1 R; 96/1.4; 96/1.5 D

[58] Field of Search ..... 96/1 R, 1.5 D, 1.5; 252/62.1 P

[56] References Cited

U.S. PATENT DOCUMENTS

| | | | |
|---|---|---|---|
| 2,461,473 | 12/1946 | Kaszuba | 96/87 A |
| 3,130,933 | 4/1964 | Pillsbury et al. | 118/77 |
| 3,489,560 | 1/1970 | Joseph | 96/1.5 |
| 3,501,294 | 3/1970 | Joseph | 96/1.4 |
| 3,552,850 | 1/1971 | Royka et al. | 355/15 |
| 3,652,319 | 3/1972 | Amidon et al. | 96/1.4 |
| 3,948,654 | 4/1976 | Fisher | 96/1.5 D |
| 3,951,835 | 4/1976 | Tomono et al. | 96/1.5 D |

*Primary Examiner*—Roland E. Martin, Jr.

[57] ABSTRACT

An improved process is given whereby an imaging surface is treated with compositions which include substantially unbranched, primary and secondary amides of ω — and cis alkenoic acids.

27 Claims, 4 Drawing Figures

AMIDES OF ω — AND CIS ALKENOIC ACIDS IN IMAGING PROCESS AND ELEMENT

This invention relates to an improved imaging process. The invention further relates to an apparatus used in the above process and an imaging member. More specifically, the improved imaging process of this invention involves treating the imaging surface of the photoconductor or imaging member of the photoconductor or imaging member of the apparatus with a material which contains primary and secondary amides of ω-alkenoic and cis-alkenoic acids having from about 10 to about 22 carbon atoms. By providing a deposit of the material of this invention over substantially all of the imaging surface, transfer and removal of toner particles from the imaging surface is facilitated.

The formation and development of images on the surface of photoconductive materials by electrostatographic means is well known. The basic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely divided electroscopic material referred to in the art as "toner". The toner is normally attracted to those areas of the layer which retain the charge, thereby forming a toner image which corresponds to the latent image. This image may be used or transferred to a support surface; the transferred image may then be permanently affixed to the support surface.

Many methods are known for applying the electroscopic particles to the latent electrostatic image for development. One development method known as "cascade" development employs developer material comprising relatively large carrier particles having finely divided toner particles electrostatically clinging to their surface which is conveyed to and rolled or cascaded across the latent electrostatic image bearing surface. The composition of the toner particles is so chosen as to have a triboelectric polarity opposite that of the carrier particles. In order to develop a negatively charged latent electrostatic image, an electroscopic powder and carrier combination should be selected in which the powder is triboelectrically positive in relation to the carrier. Conversely, to develop a positively charged latent electrostatic image, the electroscopic powder and carrier should be selected in which the powder is triboelectrically negative in relation to the carrier. This triboelectric relationship between the powder and carrier depends on their relative positions in a triboelectric series where the materials are arranged in such a way that each material is charged with a positive electrical charge when contacted with any material below it in the series and with a negative electrical charge when contacted with any material above it in the series. As the mixture cascades or rolls across the image bearing surface, the toner particles are electrostatically deposited and secured to the charged portions of the latent image and are not normally deposited on the uncharged or background portions of the image. Most of the toner particles accidentially deposited in the background are removed by the rolling carrier, apparently due to the greater electrostatic attraction between the toner and the carrier than between the toner and the substantially discharged background. The carrier particles and unused toner particles may optionally be recycled. This technique is extremely good for the development of line copy images.

Another technique for developing electrostatic images is the so-called "magnetic brush" process where a developer material containing toner and magnetic carrier particles is carried by a magnetic field of a magnet which causes alignment of the magnetic carriers in a brush-like configuration. This "magnetic brush" is engaged with an electrostatic image bearing surface and the toner particles are drawn from the brush to the electrostatic image by electrostatic attraction. Many other methods together with numerous variations of the above are well known to the art.

In automatic electrostatographic copying equipment, it is conventional to employ an imaging plate in the form of an endless imaging surface which is continuously rotated through a cycle of sequential operations including charging exposing, developing, transfer and cleaning. The plate is usually charged by means of a corona generating device connected to a suitable source of high potential. After forming a powder image on the electrostatic latent image during the development step, the powder image is electrostatically transferred to a support surface by means of a corona generating device, such as the corona device mentioned above. In automatic equipment employing a rotating drum, a receiving surface, to which a powder image is to be transferred is moved through the equipment at the same rate as the periphery of the drum and contacts the drum at the transfer position interposed between the drum surface and the corona generating device. Transfer is effected by a corona generating device which imparts an electrostatic charge to attract the powder image from the drum to the support surface. The polarity of charge required to effect image transfer is dependent upon the visual form of the original copy relative to the reproduction and the electroscopic characteristics of the developing material employed to effect development. For example, where a positive reproduction is to be made of a positive original, it is conventional to employ a positive polarity corona to effect transfer of a negatively charged toner image to a receiving surface. When a positive reproduction from a negative original is desired, it is conventional to employ a positively charged developing material which is repelled by the charged areas on the plate and deposits on the discharged areas to form a positive image which may be transferred by negative polarity corona. In either case, a residual powder image usually remains on the plate after transfer. Before the photoconductor may be reused for a subsequent cycle, it is necessary that the residual image be removed to prevent unwanted residual images from forming on subsequent copies and to prevent residual film buildup on the photoreceptor. In the positive reproduction process described above, the residual developer powder is tightly retained on the plate surface by a phenomenon that is not fully understood but believed to be caused in part by an electrical charge that prevents complete transfer of the powder to the receiving surface, particularly in the image area. This charge is substantially neutralized by means of a corona generating device prior to contact of the residual powder image with a cleaning device. The neutralization of the charge enhances the cleaning efficiency of the cleaning device.

Various electrostatographic plate cleaning devices such as "brush," "web" and "blade" type cleaning apparatus are known in the art. Brush type cleaning means usually comprise one or more rotating brushes which brush residual powder from the plate into a stream of air which is exhausted through a filtering system. Typical web cleaning devices remove residual powder from the plate by passing a fibrous web material over the plate surface. Blade cleaning is accomplished by positioning a blade against the moving plate surface to plow or otherwise effect removal.

Details, techniques, and materials employed in the above and other related processes are more fully described in U.S. Pat. Nos. 2,297,691; 2,618,552; 2,777,957; 2,832,977; 2,874,063; 2,895,847 and 3,186,838 whose disclosures and teachings are herein incorporated by reference.

The sensitivity of the imaging member to abrasion, however, requires that special precautions be exercised during the cleaning phase of the copying cycle. For example, pressure contact between blade or cleaning webs and the imaging surfaces must be kept to a minimum to prevent rapid destruction of the imaging surface. Although thick protective coatings would protect the imaging surfaces for longer periods of time, the electrical properties of the imaging member layer impose certain limitations as to the acceptable maximum thickness of the coating. Since thick protective coatings are normally applied by conventional coating techniques, including the use film forming material suspended in a solvent, considerable inconvenience, expense and time is involved in removing the photoreceptor from the machine, preparing the eroded photoreceptor surface for reception of a new coating, applying the new coating, allowing the new coating to dry and reinstalling the newly coated photoreceptor into the machine.

Certain films, applied to the imaging surface as a pretreatment or in situ during the machine sequence have been successful. U.S. Pat. Nos. 3,501,294; 3,590,000 and 3,884,825 are but a few of the many patents teaching such materials and techniques. However, the art is constantly searching for improved films or at least practical alternatives, Furthermore, for reasons which are not entirely clear, toner particles are frequently difficult to remove from some photoreceptor coating materials, and toner accumulation causes deterioration of subsequent images formed on the photoreceptor surface in reusable imaging systems. Thus, there is a continuing need for a better system for protecting imaging surfaces, developing electrostatic latent images and removing residual developed images.

It is therefore the objective of this invention to provide an improved imaging process and system to overcome the above noted deficiencies in the prior art.

A more specific objective of this invention is to provide an improved imaging process permitting greater ease of transfer and removal of toner particles from the surface of the imaging member.

Another of the objectives of this invention is to provide an improved imaging member which reduces mechanical abrasion to the cleaning member.

Still yet another of the objectives of this invention is to provide an apparatus for carrying out the above process.

Other objects and advantages will become apparent from a full reading of and understanding of this specification.

The foregoing and related objectives are accomplished by providing an imaging process which comprises the steps of forming a latent image on an imaging surface, developing said latent image by bringing a developing material within the influence of said latent image thereby enabling formation of a powder image on the imaging surface corresponding to the latent image and removing at least a portion of at least any residual developed image from the imaging surface; wherein the improvement comprises treating at least a portion of said imaging surface with a material comprising primary and secondary amides of substantially unbranched, straight chained $\omega$- and cis-alkenoic acids of about 10 to about 22 carbon atoms.

Such treatment of the imaging surface is usually performed prior to latent image formation and subsequent to removal of residual developed image from the imaging member.

This invention also embraces an imaging member treated with an adherent film of the above agent as well as an apparatus having such a treated imaging member.

In the preferred embodiments of this invention, the apparatus is an automatic electrostatographic copier having a continuous imaging member and means for application of the above lubricant to said imaging member.

This invention will also be described with reference to the drawings where

In the imaging process of this invention, the imaging member is treated with an agent of the type described previously. The method of treatment must be designed to insure the deposition of the agent over at least about 20 percent of the imaging surface of the imaging member during cyclic use. The deposition may be a deposit, coating, or film in character. The term "film" is inclusive of continuous and discontinuous coatings of lubricants on the imaging surface of the imaging member.

The depth of the deposition on the imaging member must also be carefully monitored in order to insure that sufficient quantities are deposited on the imaging surface to effectively assist in the transfer and release of toner particles from its surface. The amount required to be deposited on the imaging surface of the imaging member to effectively achieve the objectives of this invention should be sufficient to provide a deposit on said imaging surface of at least about 1A in average depth. If excessive amounts are allowed to build up on the imaging surface, imaging and development on said surface can be adversely affected. Deposits having an average depth of from about 2–200A appear to provide the imaging surface with a good balance of imaging development and toner release properties and are, therefore, preferred.

Any effective means can be used to maintain the deposit depth within the above specified limits. Whatever the means ultimately selected for maintaining the depth at a predetermined level, it must not, however, be so effective as to strip the imaging surface clean of the depositing agent. Means, for example, which can be used to dispense and maintain the agent within the above specified limits can be a rotating brush, a fibrous web, a wiper blade, a sponge-like material, an aerosol or any combination thereof. The depth on the imaging surface can be continuously monitored by any of a number of well-known techniques. For example, one could readily determine such layer thickness ellipsometrically by taking comparative readings from a treated and untreated portion of the drum at a fixed wavelength; or more simply by incorporating radioactive tracer materials into the depositing material used in treating the imaging surface and measuring the amount of radioactivity on the treated imaging surface.

Figure 1:
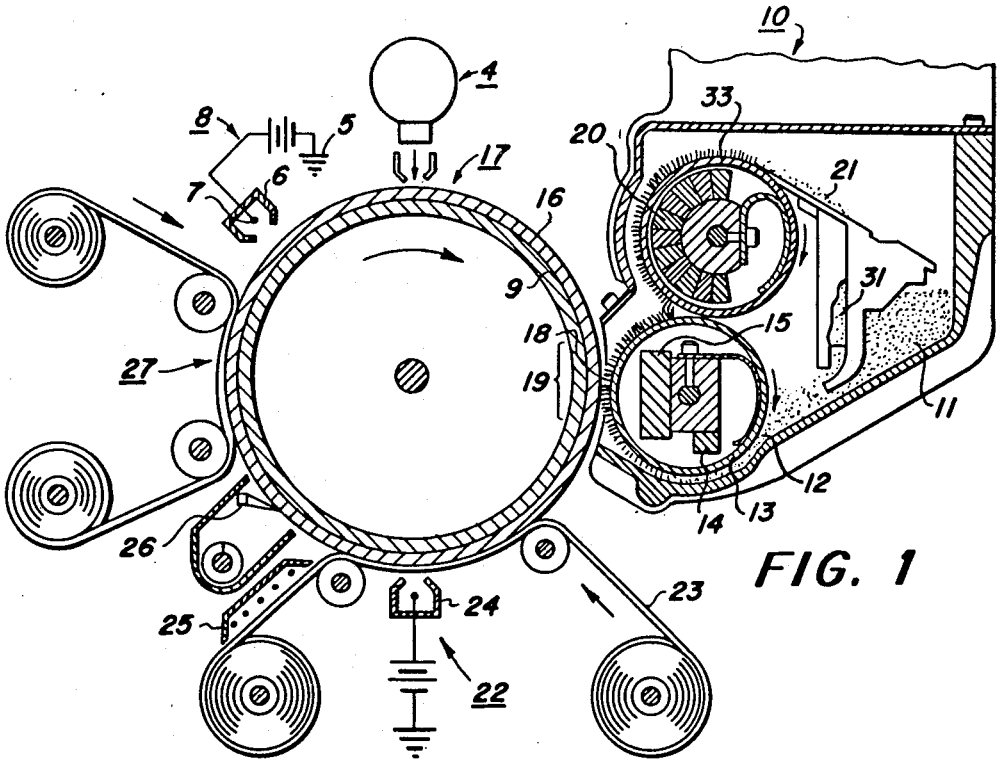
FIG. 1 is an elevational view in vertical cross-section of an automatic electrostatographic copier having a continuous imaging member and an impregnated web arrangement for dispensing lubricant.

This process is hereinafter described by reference to FIGS. 1–4. Referring initially to FIG. 1 an automatic electrostatographic imaging apparatus is shown which comprises a drum-like imaging member 17, having a light sensitive insulative layer 16 operatively associated with an electrically conductive substrate 9 rotatably mounted to enable the light sensitive insulative layer or imaging surface of the imaging member to sequentially pass in the direction indicated by the arrow past a plurality of electrostatographic process stations located peripherally to the imaging surface.

For the purposes of the present disclosure, the several electrostatographic processing stations located peripherally to the imaging surface are functionally typical of thos routinely employed in an electrostatographic reproducing cycle and can be described as follows.

A charging station 8, preferably located as indicated in FIG. 1 comprising a corona discharge device which includes an array of one or more corona discharge electrodes 7 partially enveloped within a shield 6 and energized from a high potential source 5, ionizing the air adjacent to the imaging surface of the imaging member, thereby imparting a uniform surface charge thereto. Once charged, that portion of the imaging surface bearing the surface charge is subjected to exposure by a light image at exposure station 4 wherein an optical scanning projection system projects an image onto the charged imaging surface from a stationary original thereby forming a latent electrostatic image on said imaging surface.

The imaging surface bearing this latent electrostatic image then revolves to a development station 10 where a developer 11 is drawn from a sump 12 to a rotatable applicator sleeve 13 by a pick-up magnet 14 located within the applicator sleeve. As the applicator sleeve rotates in the direction indicated by the arrow, the attracted developer moves with the applicator sleeve to a brush forming magnet 15 (also located within the applicator sleeve), resulting in alignment of the developer along the lines of flux generated by the brush forming magnet between the applicator sleeve and the imaging surface 16 of the imaging member 17. The aligned developer particles from a soft brush-like structure 18 which, upon counter-rotation of the applicator sleeve and the imaging member, "wipes" the imaging surface, selectively depositing developer particles on the imaged areas of the imaging surface.

After the applicator sleeve bearing the brush-like developer structure revolves beyond development zone 19, the developer passes under the influence of a third magnet 20 located within a pick-off sleeve 33. As the pick-off sleeve revolves in the direction indicated by the arrow, developer particles, attracted by the internal field of magnet 20 are transferred from the applicator to the pick-off sleeve and consequently transported to a replenishment zone 21. In this replenishment zone additional toner and carrier are added to the recovered developer and the resultant mixture tumbled through a series of angularly inclined baffles 22 returning ultimately to the sump. This baffle arrangement should provide for uniform distribution of developer in the sump in order to insure presentation of a continuous supply of developer along the surface of the applicator sleeve disposed opposite pick-up magnet 14. Positioned subsequent to the developer station along the arc of travel of the imaging member is an image transfer station 32, where a transfer sheet 23, such as paper, is fed in coordination with the presentation of the developed image on the drum. Concurrently with presentation of the transfer sheet opposite the developed image, an electrostatic field is created by a corona discharge device 24 on the underside of the transfer sheet so as to effectively tack the developed image to the transfer sheet. This synchronous movement of the transfer sheet along the imaging member permits transfer of the developed image to this sheet where it can be subsequently more permanently affixed by means of heat fusion device 25 or other well known techniques. After the developed image is transferred to the receiving sheet and the receiving sheet picked off the drum, substantially all residual toner particles remaining on the imaging surface are removed by impinging a doctor blade 26 in a chiseling attitude against said imaging surface. Upon removal of substantially all residual toner particles from the imaging surface, said imaging surface is contacted with a fibrous web material 27 which has been impregnated with one or more of the aforedescribed agents. As this impregnated web advances over the imaging surface in the direction indicated by the arrow an adherent deposit or film is deposited over substantially all of said imaging surface.

Figure 2:
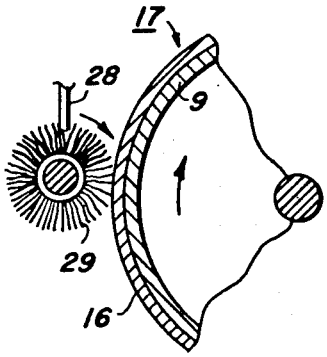
FIG. 2 is an elevational view in vertical cross-section of a bar-brush arrangement for dispensing lubricant on the imaging surface of an imaging member.

In FIG. 2, the imaging surface is treated with the agents of this invention by a rotating brush 29 impinging upon the imaging surface of the imaging member. As the brush rotates, it picks up material from an erodible bar 28 which is fed at a controlled rate toward the brush.

Figure 3:
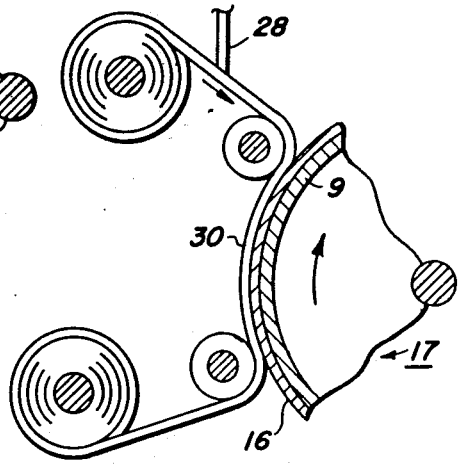
FIG. 3 is an elevational view in vertical cross-section of a bar-web arrangement for dispensing lubricant on the imaging surface of an imaging member.

In FIG. 3, the imaging surface is treated in the manner illustrated by FIG. 1; however, material is applied to the fibrous web 30 typically by controlled feeding of an erodible bar 28 against the surface of the web prior to the web impinging upon the imaging surface of the imaging member.

Figure 4:
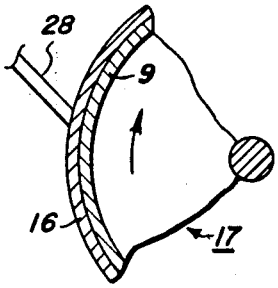
FIG. 4 is an elevational view in vertical cross-section of solid bar arrangement for dispensing lubricant on the imaging surface of an imaging member.

In FIG. 4, the material of this invention is dispensed directly onto the imaging member by controlled feeding of an erodible bar 28 against the imaging surface. In each of the above specific embodiments illustrated in FIGS. 1–4, the depth of the film on the imaging surface is controlled by the same doctor blade used in removal of toner residues.

It will be appreciated by those skilled in the art that the above-mentioned systems may employ any convenient cleaning device including, but not limited to brush, web, and blade cleaning as mentioned above.

The imaging member referred to hereinabove in discussion of the process and apparatus of this invention can comprise any known reusable imaging surface. The physical shape and dimensions of this element can vary with the type and functional of apparatus in which it is employed. For example, in an automatic or cyclic copying system, the imaging member will usually be either drum shaped, having a reusable imaging surface on its exterior wall, or an endless or a disposable belt. Other apparatus may call for the imaging member to be in the form of a plate; and under such circumstances the imaging layer will usually be on at least one of the surfaces of the plate.

As indicated above, the imaging member can be any suitable imaging surface, including conventional photoconductive and non-photoconductive surfaces. Well-known photoconductive materials include vitreous selenium, zinc oxide, organic or inorganic photoconductors embedded in a non-photoconductive matrix, or inorganic or organic photoconductors embedded in a photoconductive matrix, or homogeneous organic photoconductors, typified by PVK/TNF photoconductors and the like. Representative patents which disclose contemplated photoconductive materials include U.S. Pat. Nos. 2,803,542; 2,970,906; 3,131,006; 3,121,007; 3,151,982 and 3,484,237. The preferred imaging member used in the process and apparatus of this invention has a selenium based imaging surface on a rigid electrically conductive substrate, such as aluminum. The physical shape of this reusable imaging member should preferably be suited for cyclic or automatic operation in an electrostatographic copying system.

The application and maintenance of an adherent deposit on at least a portion of the imaging surface of this type of imaging member protects the imaging surface from abrasion, facilitates image development, developed image transfer and minimization of toner filming or buildup on the imaging surface.

The exact mechanism by which the previously described materials affect adherence of toner to the imaging surface of the imaging member is not as yet known. Without wishing to be bound by theory or scientific speculation it is believed that the materials of this invention adsorb onto the photoreceptor surface. Thereby, a very thin film of the lubricant material may be formed in such a way as to provide an abrasion resistant surface to which toner particles have relatively little tendency to adhere.

Materials useful within the scope of this invention are primary and secondary amides of the following structure;

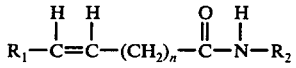

where $R_1$ may be H or an alkyl group of 1 to about 18 carbon atoms, and $n$ is selected to have a value such that the total number of carbon atoms is from about 10 to about 22, $R_2$ may be H, phenyl, lower alkyl substituted phenyl, and lower alkyl groups where lower alkyl includes from 1 to about 7 carbon atoms in either branched, straight chained, or cyclic configuration. It will be recognized that the compositions are of the $\omega$-type when $R_1$ is H.

The properties of these materials make them useful in this invention. They are generally solids at room and ambient temperatures of the operation system.

Because of their easy availability, oleamide

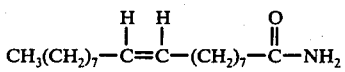

and 10-undecenamide

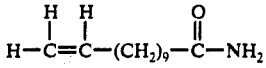

are particularly preferred.

These materials are easily produced using standard laboratory procedures and are commercially available from Aldrich Chemical Company, Inc., of Milwaukee, Wis. under their generic chemical names.

The amides of this invention are well known and many are available in commercial quantities being staple articles of commerce. Because of their chemical properties, often the commercially available form is a mixture of related amides and reaction products having a preponderence of the named or identified amide contained therein. Such commerical products have been found to work satisfactorily in the practice of this invention.

The examples which follow further describe, define and illustrate specific embodiments of the process and apparatus of this invention. Examples I and V are included to provide a standard against which the performance of the treated imaging members can be evaluated. All parts and percentages are by weight unless otherwise specified.

EXAMPLE I (STANDARD FOR COMPARISON)

The vitreous selenium photoconductive drum of an automatic electrostatographic copier is corona charged to a positive volatage of about 800 volts, exposed to a light and shadow image thereby forming a latent electrostatic image on the imaging surface of the drum, and developed using the magnetic brush technique using a standard styrene copolymer-carbon black toner blend; the average particle size of toner particles being about 12 microns. After development the developed image is transferred to a sheet of paper, the paper bearing the developed image picked off the drum, the toner image fused on the paper, and the residual toner particles then removed from the imaging surface by a doctor blade set against the imaging surface at in a chiseling attitude.

Initial copies reveal good copy quality in all respects, however, after 500 copies image quality begins to deteriorate by showing high background density, poor image fill, and decreased image resolution. Inspection of the drum reveals a visible toner residue on the imaging surface.

EXAMPLE II

The toner laden drum of Example I is removed from the copier, thoroughly cleaned and reinstalled in the copier. The apparatus is then modified by the addition of a dispensing station between the doctor blade and the charging station. This dispensing station comprises a fibrous web material impregnated with oleamide. As the vitreous drum rotates through its copy reproduction cycle, an adherent deposit of oleamide is deposited over the imaging surface of this imaging member in the manner shown in FIG. 1. Copy quality remains relatively constant even after 500 copies in comparison to Example I, and inspection of the imaging surface of the drum reveals little of the undesirable toner residue experienced in Example I.

EXAMPLE III

Example II is repeated except for substitution of 10-undecenamide for the oleamide.

The copy quality after 500 copies was better than Example I and perceptibly less toner residue appeared on the imaging surface of the photoconductive drum than observed in Example I.

EXAMPLE IV

Example II is repeated except for the substitution of a bar-brush dispensing station for the impregnated web of Example II. The deposit forming agent, oleamide, in the form of a solid bar is transferred to the brush by the erosive action of the brush bristles as they strike the bar. As the vitreous selenium drum of the copier revolves through its reproduction cycle, an adherent deposit of oleamide is deposited over substantially all of the imaging surface of the drum by the action of the rotating brush against the drum. The copy quality remains relatively constant even after 500 copies in comparison to Example I, and inspection of the drum does not reveal undesirable toner buildup of the type experienced in Example I.

EXAMPLE V (STANDARD FOR COMPARISON)

Example I is generally repeated except that the copier is equiped with a poly-N-vinylcarbazole photoconductive imaging member of a type disclosed in U.S. Pat. No. 3,484,237. Charge and process parameters are modified for the requirements of this organic photoconductor. Here, as in Example I, toner residue on the photoconductive surface of the imaging member is observed after only 500 copies with noticeable deterioration in copy quality.

EXAMPLE VI

Example V is repeated except that (a) the toner laden photoconductive imaging member of Example V is replaced by a clean, unused imaging member of the same composition, and (b) copier is modified by the addition of a dispensing station between the doctor blade and the charging station. This dispensing station comprises a fibrous web material impregnated with oleamide. As the flexible photoconductive imaging member rotates through its copy reproduction cycle, a film of oleamide is deposited over substantially all of its imaging surface in the manner illustrated in FIG. 1. Copy quality remains relatively constant even after 500 copies in comparison to Example V, and inspection of the flexible photoconductive member reveals little of the undesirable toner residue observed in Example V.

While the present invention has been described by the specification, embodiments and drawings, the invention is not so limited. Many modifications can be made by one skilled in the art without departing from the spirit and scope of the invention which should be viewed in the light of the appended claims.

What is claimed is:

1. In an imaging process comprising the steps of forming a latent image on an imaging surface, developing said latent image by bringing a developing material within the influence of said latent image to form a powder image corresponding to said latent image, and removing at least a portion of at least any residual developed image from said imaging surface; the improvement comprising treating said imaging surface with an effective amount of a deposit forming material comprising amides of the structure

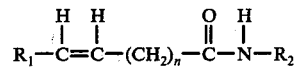

where $R_1$ is H or an alkyl group of 1 to about 18 carbon atoms, and $n$ is an integer having a value such that the total number of carbon atoms is from about 10 to about 22 and where $R_2$ is H, phenyl, lower alkyl substituted phenyl, and lower alkyl groups where lower alkyl includes from 1 to about 7 carbon atoms in branched, straight chained, or cyclic configuration.

2. The imaging process of claim 1 wherein the imaging surface is treated with oleamide.

3. The imaging process of claim 1 wherein the imaging surface is treated with 10-undecenamide.

4. An imaging process comprising:

(a) periodically dispensing on a reusable imaging surface an effective amount of a deposit forming material comprising amides of the structure

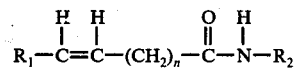

where $R_1$ is H or an alkyl of 1 to about 18 carbon atoms, and $n$ is an integer having a value such that the total number of carbon atoms is from about 10 to about 22 and where $R_2$ is H, phenyl, lower alkyl substituted phenyl, and lower alkyl groups where lower alkyl includes from 1 to about 7 carbon atoms in either branched, straight chained or cyclic configuration;

(b) forming a latent image on said reusable imaging surface;

(c) developing said latent image by bringing a developing material within the influence of said latent image;

(d) removing at least a portion of at least any residual developed image from said imaging surface; and (e) repeating step (a) through (d) in sequence at least one additional time.

5. The imaging process of claim 4 wherein the imaging surface is treated with oleamide.

6. The imaging process of claim 4 wherein the imaging surface is treated with 10-undecenamide.

7. The process of claim 4 including the step of transferring the developed image to a support surface.

8. The process of claim 4 wherein said compound is dispensed on said imaging surface by presenting against said imaging surface a treating surface carrying on at least the area adjacent said imaging surface said compound in transferable form.

9. The process of claim 4 wherein said dispensing surface is a solid bar of said compound.

10. The process of claim 4 wherein said dispensing surface is a flexible material carrying said compound to said imaging surface.

11. The process of claim 10 wherein said flexible material is a fibrous material.

12. The process of claim 11 wherein said fibrous material is in the form of a web.

13. The process of claim 11 wherein said fibrous material is in the form of a brush.

14. An imaging member wherein the imaging surface of said imaging member is provided with an adherent deposit of a material comprising amides of the structure

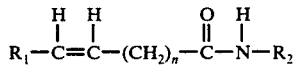

where $R_1$ is H or an alkyl of 1 to about 18 carbon atoms, and $n$ is an integer having a value such that the total number of carbon atoms is from about 10 to about 22, and where $R_2$ is H, phenyl, lower alkyl substituted phenyl, and lower alkyl groups where lower alkyl includes from 1 to about 7 carbon atoms in either branched, straight chained, or cyclic configuration.

15. The imaging member of claim 14 wherein the adherent film of lubricant is distributed over substantially all of the imaging surface.

16. The imaging member of claim 14 wherein the adherent film of lubricant has an average thickness of at least 1 A.

17. The imaging member of claim 14 wherein said imaging member is plate-like.

18. The imaging member of claim 14 wherein said imaging member is provided with an endless imaging surface.

19. The imaging member of claim 14 wherein the photoconductive surface is selenium.

20. The imaging member of claim 14 wherein said imaging surface comprises a flexible material.

21. The imaging member of claim 14 wherein the lubricant is stearamide.

22. The imaging member of claim 14 wherein the lubricant is 10-undecenamide.

23. The imaging process of claim 1 wherein said treating results in a deposit having an average depth of from about 2 to 200 angstroms.

24. The imaging process of claim 4 wherein said deposit forming material is formed in a deposit having an average depth of about 2 to 200 angstroms.

25. The imaging member of claim 14 wherein the adherent film of lubricant has an average thicness of about 2 to 200 angstroms.

26. An imaging process of claim 1 wherein said effective amount of deposit forming material comprises an amount sufficient to protect the imaging surface from abrasion, facilitate image development, facilitate developed image transfer, minimize toner filming and minimize toner build up.

27. An imaging process of claim 4 wherein said effective amount of deposit forming material comprises an amount sufficient to protect the imaging surface from abrasion, facilitate image development, facilitate developed image transfer, minimize toner filming and minimize toner build up.

* * * * *